United States Patent [19]
Jasper
[11] 4,194,678
[45] Mar. 25, 1980

[54] SHIPPING CONTAINER AND BLANK FOR FORMING SAME

[75] Inventor: Mark F. Jasper, Laguna Hills, Calif.
[73] Assignee: American Hospital Supply Corporation, Evanston, Ill.

[21] Appl. No.: 922,956
[22] Filed: Jul. 10, 1978
[51] Int. Cl.[2] ..... B65D 5/32; B65D 5/48
[52] U.S. Cl. ..... 229/23 R; 206/427; 206/564
[58] Field of Search ..... 229/23 R, 44, 45; 206/45.14, 45.19, 197, 564, 427

[56] References Cited

U.S. PATENT DOCUMENTS

| | | | |
|---|---|---|---|
| 1,367,069 | 2/1921 | Mackinnon | 206/427 X |
| 2,907,509 | 10/1959 | Chamberlin | 229/23 R X |
| 2,965,226 | 12/1960 | Ettlinger | 206/564 |
| 3,294,308 | 12/1966 | Tress et al. | 229/23 R |
| 3,409,202 | 11/1968 | Belcher | 229/23 R |
| 3,921,893 | 11/1975 | Randle, Jr. | 229/23 R |
| 4,019,634 | 4/1977 | Bonnott | 229/23 R X |

*Primary Examiner*—Davis T. Moorhead
*Attorney, Agent, or Firm*—E. A. Figg; R. E. Hartenberger

[57] ABSTRACT

A shipping container formed by joining a base member having a floor, sides, and top with a reinforcing member having front and rear panels joined by a vertical support panel. These two members combine to form a crush resistant container. Preferably, there is a pocketed insert overlying the floor and held in position as an integral part of the container by sealing together the base and reinforcing members. The container is highly crush resistant and suitable for shipping bottles of liquid, such as those containing sterile intravenous solutions or other medical liquids.

3 Claims, 6 Drawing Figures

SHIPPING CONTAINER AND BLANK FOR FORMING SAME

BACKGROUND

U.S. Pat. Nos. 3,050,228, 3,412,920, and Re. 26,557 describe shipping containers having a reinforcing crush resistant panel extending across the container. These basically include a cubical outer container of generally conventional corregated box construction with separately formed insert panels. This type of construction often wasted material in that certain areas were double walled to prevent the rigidifying panel from shifting in the carton. Also, the rigidifying panel often was not securely anchored to the main carton.

Other types of cartons with crush resistant rigidifying panels were used for eggs, etc. and are described in U.S. Pat. Nos. 2,597,846 and 4,046,307. These have complicated constructions which required three or more separate parts to be assembled into the rigidified carton.

Another problem with shipper containers for merchandise such as bottle liquids, was that they required a series of cardboard dividers as shown in the U.S. Pat. No. 3,256,983 to prevent the bottles from abrading each other and breaking during handling. This patent describes a shipper case for beer bottles.

The problem of shipping bottled liquids is compounded in the medical field in that many of the bottled liquids, in glass or plastic, have critical sterile contents that are administered into a patient's vein or used during surgery. Thus, it is extremely critical that the shipper container be sturdy so as not to crack and possibly contaminate any of the bottles of medical liquid. The containers also must be very economical, as much of the recent shipment of medical liquids has been in disposable plastic containers that are not returned to the manufacturer. Thus, the shipper case is destroyed along with the used bottles at the hospital.

SUMMARY OF THE INVENTION

The present invention overcomes the problems mentioned above and provides a unique shipper carton with a crush resistant reinforcing panel. The shipping container is extremely easy to manufacture, does not waste material, and in a preferred embodiment has a pocketed insert formed as an integral part of the container. Thus, intravenous solution bottles can be inserted into the container and their bases firmly held by such pocketed insert.

THE DRAWINGS

DETAILED DESCRIPTION

Figure 1A:
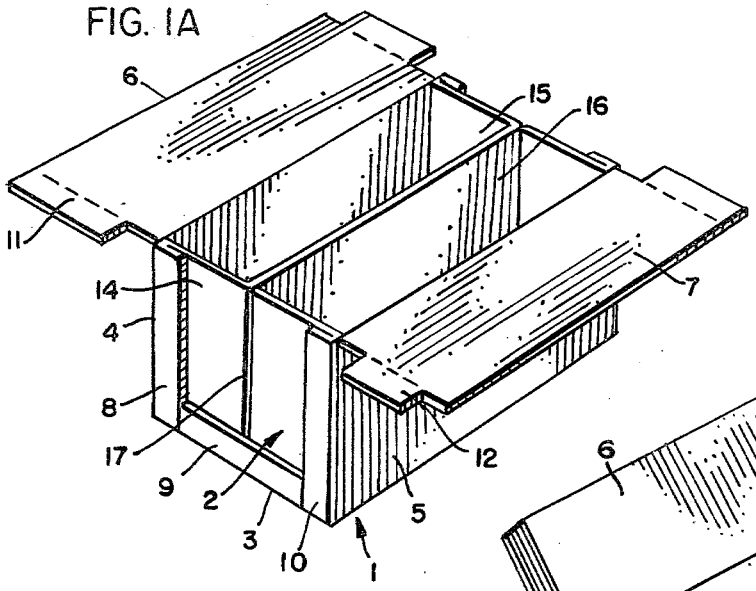
FIG. 1A and 1B are perspective views of the shipping container with its cover flap open.
Figure 1B:
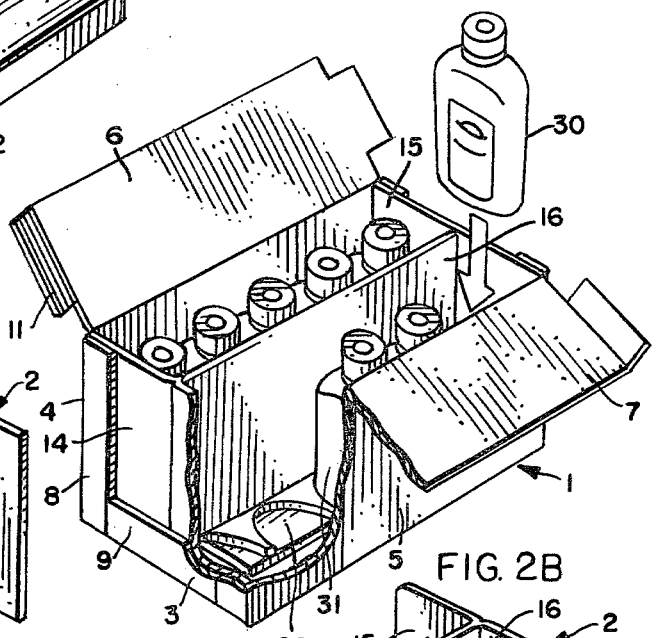

FIG. 1A and 1B show the shipping container as assembled and which includes a base member shown generally at 1 and a reinforcing member shown generally at 2. The base member includes a floor panel 3, a pair of side panels 4 and 5, and cover panels 6 and 7. The base member also includes juncture flaps 8, 9, and 10 which fold inwardly, but fail to close a front and back of the base member. Cover flaps 6 and 7 also include closure flaps 11 and 12.

The reinforcing member is generally H-shaped and has a front panel 14 and a rear panel 15 joined by a vertical reinforcing panel 16. Preferably, panel 16 is a folded over double panel construction with an interface between such two folded over panels at 17. The sealing flaps 8, 9, and 10 are adhesively bonded or stapled to the reinforcing member to form a rigid crush resistant container. Cover flaps 6 and 7 can be folded inwardly after loading the container and sealing flaps 11 and 12 folded downwardly and secured to front panel 14 of the reinforcing member. It is understood that the rear of the shipping container has a similar flap construction.

FIG. 1B shows shipping bottles 31 containing sterile intravenous solutions resting in the pocketed insert 20 of shipping container 1. Bottle 31 is representative of the shape bottle inserted into the container 1. As seen in FIG. 1B the pocketed insert 20 forms an integral part of the constructed container. Further, the pocketed insert is so formed to accommodate the shape of the bottle or container to be placed therein.

Figure 2A:
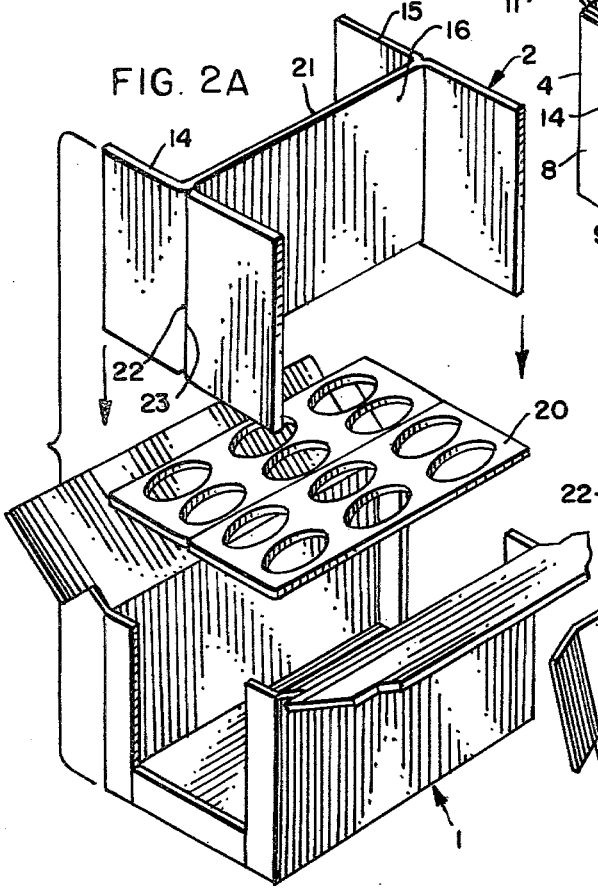
FIG. 2A and 2B are exploded views showing a reinforcing member being assembled to a base member and a pocketed insert being confined between these two members as an integral part of the container construction.
Figure 2B:
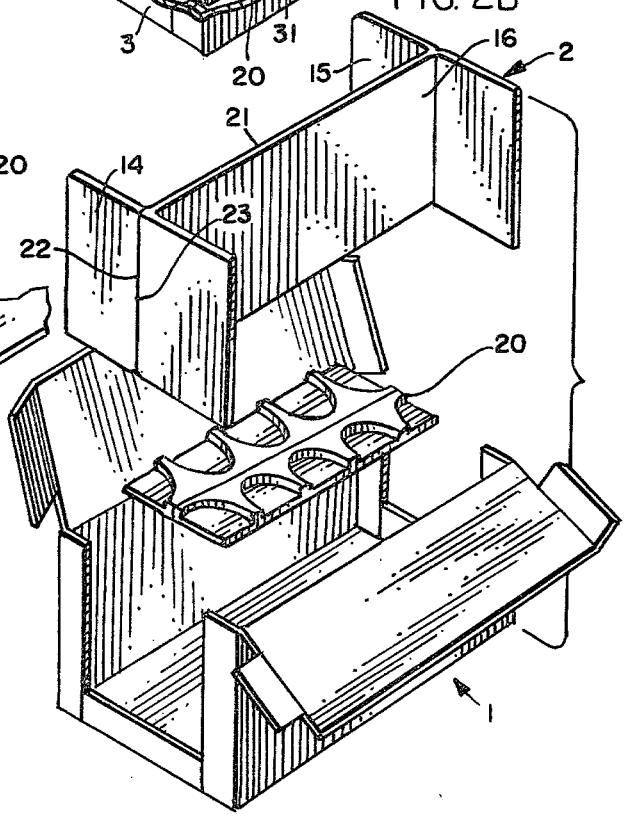

In FIGS. 2A and 2B are shown the general shape of the base member 1 and reinforcing member 2 as they are assembled together to sandwich the pocketed insert 20 between the two members. Insert 20 could be of a foamed plastic material, die cut corregated material, or a vacuum formed sheet with pockets. When the container is assembled according to FIGS. 2A and 2B, the pocketed insert 20 is firmly held in place and forms an integral part of the constructed container.

Figure 3:
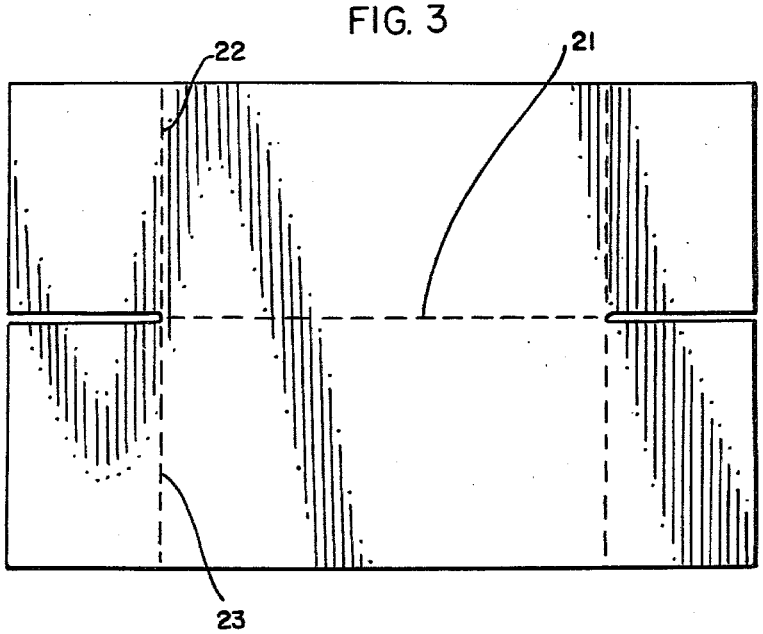
FIG. 3 is an enlarged blank for forming the reinforcing member.

FIG. 3 shows the blank for forming the reinforcing member and the upper folded hinge portion is shown in dotted line 22. Dotted line fold sections 22 and 23 form the folds as shown in FIG. 2A.

Figure 4:
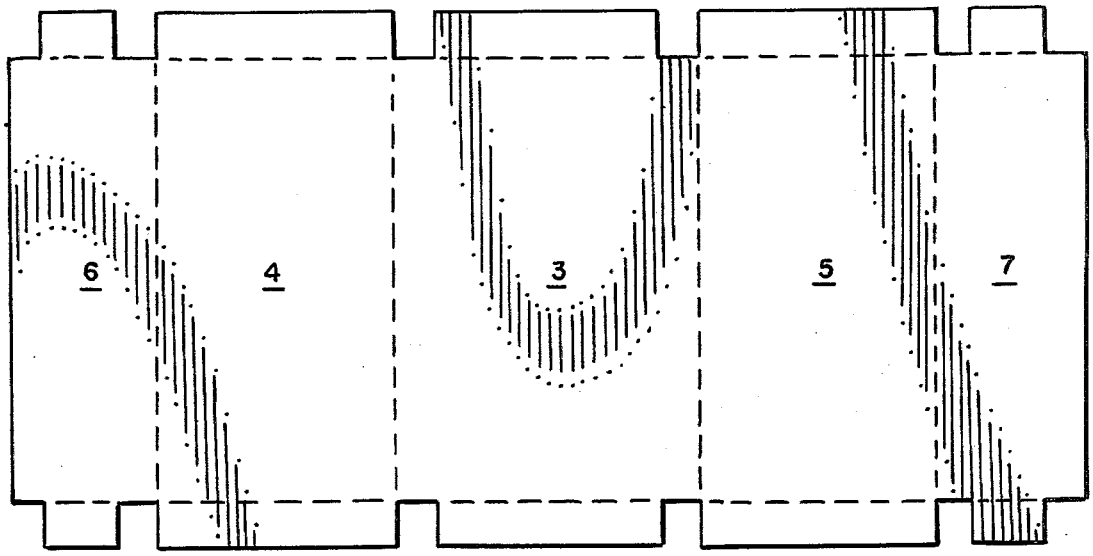
FIG. 4 is a blank for forming the base member of the container.

FIG. 4 shows the blank for the base member with the floor 3, sides 4 and 5, and cover flaps 6 and 7.

In the foregoing description, a specific example has been used to describe the invention. However, it is understood by those skilled in the art that certain modifications can be made to this example without departing from the spirit and scope of the invention.

I claim:

1. A container, comprising a base member with a floor joined to two sides forming a generally U-shaped panel open at its front and rear, and a reinforcing member joined to the base member and having front and rear panel and a verticle support panel, said reinforcing member joined to the base member to close its front and rear, and a pocketed insert secured between the base and the reinforcing member.

2. A container as set forth in claim 1, wherein the pocketed insert is positioned against the floor.

3. A container comprising: a base member with a floor; a reinforcing member with a vertical support panel secured to the base member; and a pocketed insert sealed between the two members and held against the floor to form an integral part of the container construction.

* * * * *